United States Patent [19]

Shawhan

[11] 4,390,975

[45] Jun. 28, 1983

[54] DATA TRANSMISSION IN A DRILL STRING

[75] Inventor: Elbert N. Shawhan, West Chester, Pa.

[73] Assignee: NL Sperry-Sun, Inc., Sugarland, Tex.

[21] Appl. No.: 139,046

[22] Filed: Apr. 10, 1980

Related U.S. Application Data

[63] Continuation-in-part of Ser. No. 891,657, Mar. 20, 1978, abandoned.

[51] Int. Cl.[3] ..... G01V 1/40

[52] U.S. Cl. ..... 367/82; 181/103; 175/40

[58] Field of Search ..... 367/81, 82, 134; 181/103; 166/113; 175/40, 50; 360/40, 44; 375/3, 34, 51, 55, 57

[56] References Cited

U.S. PATENT DOCUMENTS

| | | | |
|---|---|---|---|
| 2,969,526 | 1/1961 | Clapper | 360/40 |
| 3,015,801 | 1/1962 | Kalbfell | 367/82 |
| 3,293,607 | 12/1966 | Kalbfell | 367/82 |
| 3,562,726 | 2/1971 | Hamilton | 360/43 |
| 3,889,228 | 6/1975 | Shawhan | 367/82 |
| 3,930,220 | 12/1975 | Shawhan | 367/82 |
| 3,953,798 | 4/1976 | Sjostrand et al. | 375/51 |
| 3,959,816 | 5/1976 | Spiecens | 360/44 |
| 4,027,282 | 5/1979 | Jeter | 367/82 |
| 4,045,767 | 8/1977 | Nishihara et al. | 136/134 |

OTHER PUBLICATIONS

The University of Michigan Engineering Summer Conferences, "Digital Communications System," 7/23/71, p. 40.

Fogarty, "High Density Recording . . . A Communications View," 6/75, pp. 24–26, Digital Design.

Mahoney et al., Digital Communications," 1966, pp. 4&14, RCA Institute, Lecture Notes.

Schwarz "A Method to Reduce . . . Sound Transmission", 6/16/80, pp. 1–3, Tn No. 1246.

*Primary Examiner*—Nelson Moskowitz

*Attorney, Agent, or Firm*—Browning, Bushman, Zamecki & Anderson

[57] ABSTRACT

Data is transmitted through a drill string by means of acoustical energy by transmitting an acoustical signal for a first predetermined interval and ceasing transmission of the signal for a second predetermined interval to represent a first binary state; ceasing transmission of the signal for a third predetermined interval to represent a second binary state; and combining transmission and cessation of transmission of the signal in binary sequences representative of borehole data.

3 Claims, 4 Drawing Figures

PRIOR ART

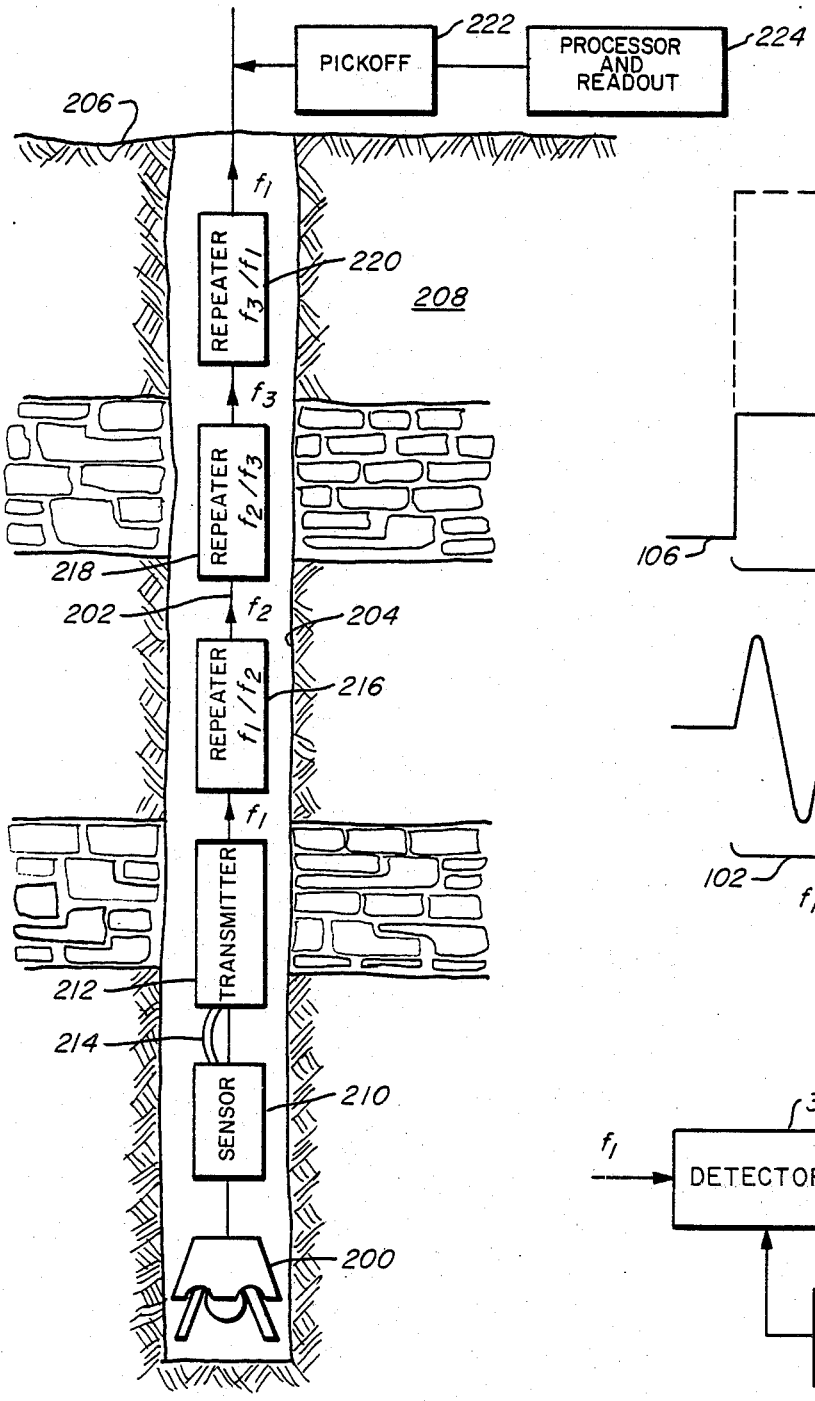
FIG. 2
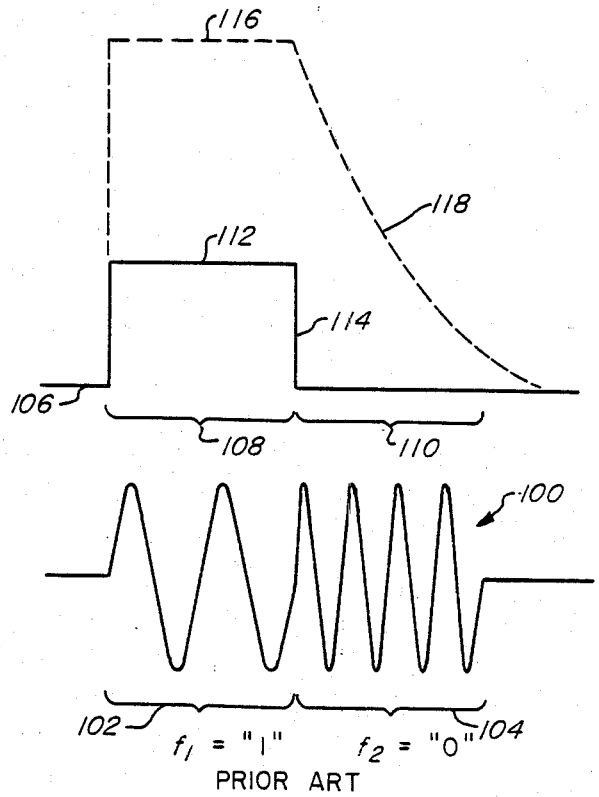
FIG. 1
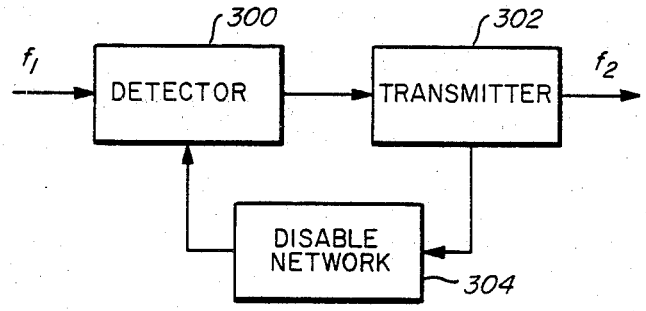
FIG. 3
FIG. 4
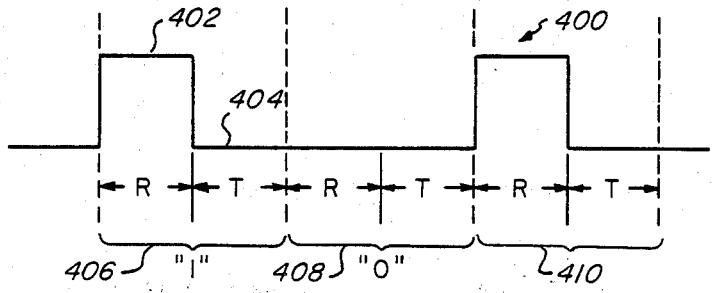

DATA TRANSMISSION IN A DRILL STRING

CROSS REFERENCE TO RELATED APPLICATION

This application is a continuation-in-part of applicant's co-pending application Ser. No. 891,657, filed Mar. 20, 1978, now abandoned.

BACKGROUND OF THE INVENTION

1. Field of the invention

The invention relates to transmission of signals in a borehole, and more particularly to transmission of acoustical signals through a drill pipe.

2. Technical considerations

The desirability of telemetering information to the surface from a borehole while drilling has long been recognized. The best method presently in use is to cease drilling and lower an electronic instrument package into the borehole by means of a conductor cable to measure temperature, pressure, inclination, direction, etc. Borehole conditions of interest are measured and transmitted electrically up the cable to the surface where they are interpreted and displayed on surface instruments. After use the instrument and cable must be removed from the borehole before recommencing drilling in rotary drilling is used. Use can be left in place until another section of drill pipe must be added to the drill string, however, if a downhole mud motor is used to drive the drill bit. Insertion and removal of such instruments require a considerable amount of time during which drilling cannot occur. It has been estimated that elimination of such costly drilling rig down-time by means of while-drilling telemetry systems could eliminate 5% to 6% of direct production platform drilling costs in offshore platforms.

The applicant has disclosed in previous patents, e.g., U.S. Pat. No. 4,019,148, utilization of an acoustical transmission system in which an acoustical signal is inserted into a drill string at one location at a "nominal" frequency and is detected at a second location. The signal is then repeated and retransmitted at a second nominal frequency to a second detector, where it is in turn repeated and retransmitted to a third detector located at a third position in the drill string. After the third repeater the sequence of frequencies is repeated in subsequent repeaters until the signal reaches the surface and is detected and read out. It was disclosed in U.S. application Ser. No. 644,686 now U.S. Pat. No. 4,019,148 that these nominal frequencies are in fact two frequencies that are separated by only a very small frequency difference (e.g., 20 Hz.). In that application it was disclosed that information is encoded into an intelligible form for acoustical transmission along the drill string into binary coded data according to the frequency-shift-keyed modulation (FSK) system. The information concerning borehole parameters is converted from analog or other form to digitally coded words which are used to modulate the FSK system. The FSK system represents digital data by shifting between the aforementioned two nominal frequencies. One frequency is used to represent a binary "zero" and the other to represent a binary "one," and by shifting between the two frequencies in the proper sequence binary words can be represented. The encoded FSK signals can then be used to drive an electro-acoustical transducer, or other suitable device, which induces the desired signals into the drill string in the form of acoustical signals.

It has been found that several problems are associated with this type of modulation system. It was found to be a characteristic of drill pipe that signals once induced tend to continue to oscillate or "ring" long after the driving signal has been removed. This is a fact that was not recognized previous to the present invention by either the applicant or by others. It was assumed that drill pipe would act like other acoustical conductors and would dampen out any ringing by the well known process of attenuation. It has been discovered, however, by the applicant that for unknown reasons, whether it be the tubular shape of the drill pipe, the length of the drill pipe, the manner in which drill pipes are conventionally interconnected, or other reasons, the assumptions extant in the prior art are erroneous. It was also found that the problems are compounded by the use of two frequencies that are close together. Phase delays and ringing found by the applicant to be inherent in the transmission of acoustical signals in a drill pipe cause interference and intermodulation between the two different signals, thereby destroying the coherency and thus the informational value of the signals.

OBJECTS AND SUMMARY OF THE INVENTION

It is an object of the invention to transmit acoustical information signals in a drill string in a coherent manner. This is accomplished by transmitting a signal for a predetermined length of time and ceasing such transmission for a second predetermined length of time and combining such transmission and cessation in predetermined time frames in a manner to impart informational significance to such transmission and cessation.

It is another object of the invention to transmit acoustical information signals through a drill string in a manner such that retransmission of such signals does not interfere with the reception of such signals. This is accomplished by transmitting a signal for a portion of a time frame and ceasing transmission of such signal for a second portion of a time frame to represent a first binary state and ceasing transmission of such signal for all of a time frame to represent a second binary state. Retransmission of the signal occurs only during the second portion of the time frame, and during such retransmission reception of the signal is blanked.

It is a further object of the invention to provide a telemetry system through a drill string of great length. This is accomplished by transmitting a signal by the method previously described at a first frequency from a first location and receiving it at a second location at the same frequency retransmitting the signal to and receiving it at a third location at a second frequency, retransmitting the signal to and receiving it at a fourth location at a third frequency and repeating the reception and retransmission in the same frequency sequence until the signal reaches a desired location.

DESCRIPTION OF THE DRAWINGS

The invention may be more fully understood by reading the following description of a preferred embodiment in conjunction with the appended drawings, wherein:

FIG. 1 is a graph illustrating the prior art and the theory of the invention;

FIG. 2 is a block diagram of a drill string acoustical signal transmission system in which the invention may be utilized;

FIG. 3 is a block diagram of the reception and retransmission apparatus utilized by the invention; and FIG. 4 is a graph illustrating the method of the invention.

THEORY OF THE INVENTION

Referring to FIG. 1 a diagram illustrating the transmission characteristics of a drill pipe is shown. Signal 100 is a typical FSK modulated signal having a portion 102 at a frequency $F_1$ representing a digital "one" and a portion 104 at a frequency $F_2$ representing a digital "zero". Signal 106 represents a DC analog of signal 100 and has a pulse portion 108 representing the digital "one" and a zero level portion 110 representing the digital "zero". Signal 106 is shown in two different states. State 112 shows the signal response in a nonresonant condition in the drill pipe. The signal has a relatively low level and is accompanied by a following edge 114 having a sharp drop off. Signal 116 represents the same signal in a resonant condition in a drill pipe. This signal has a relatively higher amplitude, but in this case is accompanied by a slowly decaying following edge 118. It is well known that an excitation in a resonant system will resonate while the system is being excited and will continue to resonate, although decreasing with time, long after the excitation has ceased to be applied. Following edge 118, therefore, represents the decaying portion of signal 106 in a resonant drill pipe condition. It can readily be seen that in portion 110 the signal representing the digital "one" is still present when in fact it is desired that the signal level be at zero in order to represent a digital "zero".

DESCRIPTION OF THE PREFERRED EMBODIMENTS

Referring to FIG. 2, an acoustical information telemetry system in which the present invention may be used is shown. The telemetry system is incorporated into a conventional drilling apparatus that includes a drill bit 200 and a drill stem 202, which are used to drill a borehole 204 from the surface 206 through earth formations 208.

Information concerning parameters in a borehole is often desirable during drilling to plan further progression of the hole. This can be secured by a sensor 210, or a similar device, secured in the drill string. Sensors 210 can, for example, be an orientation sensing device, such as a steering tool, that provides information necessary for directional drilling. This type of device would normally be placed in the drill string very near bit 200 as shown in FIG. 2.

Information generated by sensor 210 is usually sent to the surface 206 where it can be evaluated and utilized. One transmission system useful for such purposes is an acoustical telemetry system that uses the drill string 202 as a transmission medium. The information is sent along drill string 202 by an acoustical transmitter 212, which receives the information from nearby sensor 210 through an electrical conductor 214, or by other suitable means and method of transmission.

The information is then encoded into an intelligible form that is compatible with the particular form of transmission chosen. The manner of such encoding and transmission is the subject of the present invention. Acoustical waves suffer attenuation with increasing distance from their source at a rate dependent upon the composition characteristics of the transmission medium. Many boreholes are so deep that signals sent by transmitter 212 will not reach the surface before they are attenuated to a level at which they are indistinguishable from noise present in the drill string.

In order that the signals reach the surface, they may have to be amplified several times. However, since some waves travel in both directions along the drill string, some method is desirable that will ensure that the information signals will be propogated in only one direction. Otherwise an amplifier would amplify signals coming from both above and below itself, thereby causing oscillations and rendering the system ineffective. One method that has been found suitable for producing directional isolation uses frequency shifts among three or more frequencies. Transmitter 212 starts the transmission process by transmitting the signal at a frequency $F_1$. A repeater 216 capable of receiving frequency $F_1$ is positioned in the drill string above transmitter 212. Repeater 216 alters the signal from frequency $F_1$ to frequency $F_2$.

The signal at frequency $F_2$ is sent along drill string 202 and is received by repeater 218 which will receive only signals of frequency $F_2$. Repeater 218 then transforms its signal to a frequency $F_3$ and retransmits it. The signal of frequency $F_3$ travels in both directions along drill string 202, but it can be received only by a repeater 220, which receives at $F_3$ and retransmits at $F_1$. The signal cannot be received by repeater 216 since it will receive only $F_1$. In this manner, directionality is assured using three frequencies if alternate repeaters capable of receiving the same frequency are further apart than the distance necessary for the signal to attenuate to an undetectable level.

A sufficient number of repeaters to transmit the signal to the surface is used, repeating the sequence established by repeaters 216, 218, and 220 until the surface is reached. In FIG. 2 only three repeaters are shown, although a larger number may be used. In the system of FIG. 2, repeater 220 performs the final transmission to the surface at $F_1$. At the surface a pickoff 222, which includes a receiver similar to that used in the repeaters, detects the signal in drill string 202. The pickoff sends a signal to a processor and readout device 224, which decodes the signal and places it in a useable form.

Referring to FIG. 3, a block diagram of a repeater is shown. The repeater comprises a detector 300, a transmitter 302 and a disable network 304. It should be recognized that while the components shown in FIG. 3 comprise a repeater, transmitter 302 may be used separately and in substantially the same configuration as transmitter 212. In addition, detector 300 may be similarly used as pickoff 222. Although repeater 216 is utilized for explanatory purposes, its operation and construction is exactly the same as that for repeaters 218 and 220 with changes only to alter the receive and transmit frequencies. Referring to repeater 216 for illustrative purposes, detector 300 receives a signal at $F_1$ and reconstructs the original wave form, compensating for losses and distortion occurring during transmission through the drill pipe. Detection can be accomplished, for example, by means of a transducer such as a magnetostrictive or electrostrictive device. The reconstructed signal then enters transmitter 302 where it is again applied to a transducer of the type discussed in connection with detector 300. In order to prevent chatter, which is analogous to oscillation in an analog network, transmitter 302 is operative only during times that detector 300 is certain not to receive a signal, as will be discussed in more detail in connection with FIG. 4. In addition operation of transmitter 302 actuates a disable network 304 which prevents detector 300 from receiving a signal while transmitter 302 is transmitting.

Referring to FIG. 4, the method of reception and transmission of an acoustical signal in a drill pipe is illustrated by means of a signal diagram. Signal 400, which consists of a sequence of DC pulses 402 interspersed with segments of zero voltage 404, is divided into a number of time frames 406, 408, 410, etc. Each of these time frames represents a single bit of digital information. For example, time frame 406 represents a "one" and time frame 408 represents a "zero." The time frames are referenced, i.e., sink is achieved, by transmitting a predetermined number of one's. As will be noted from the figure a one consists of a portion of a time frame, 406 for example, in which a DC pulse 402 is generated and a portion 404 in which a zero signal is generated. The pulse and zero signal portions of time frame 406 may be in any order and of any relative duration. It is preferable that portion 402 be smaller than portion 404 to provide extra time for the tuned circuit effects discussed in connection with FIG. 1 to subside. A zero is represented by a time frame in which there is an absence of a signal, as in 408 for example.

FIG. 4 also illustrates the manner in which the detector 300 and transmitter 302 operate in coordination. The letter R represents the portion of a time frame during which detector 300 is operative and the letter T the time during which transmitter 302 is operative. From this it may be seen that the transmitter never operates while the detector, or receiver, is operative, and vice versa. In this way possible feedback from the transmitter of a particular repeater to the receiver portion of the same repeater is prevented. Further isolation is provided, as outlined in connection with FIG. 3, by the disabling of detector 300 whenever transmitter 302 is in operation.

While particular embodiments of the present invention have been shown and described, it is apparent from the foregoing description that changes and alterations may be made without departing from the true scope and spirit of the invention. It is the intention in the appended claims to cover all such changes and modifications.

What is claimed is:

1. In a borehole drilling apparatus, a method of acoustically transmitting borehole data through a drill string which, due to the drill string configuration, inherently provides a resonant environment for acoustic signals transmitted therethrough, comprising the steps of:

transmitting an acoustical signal in the drill string for a first predetermined interval and ceasing transmission of the signal for a second predetermined interval, wherein the first interval is shorter than the second to ensure sufficient time to permit decay of the acoustic signal transmitted during the first predetermined interval to represent a first binary state;

ceasing transmission of said signal for a third predetermined interval to represent a second binary state; and combining transmission and cessation of transmission of said signal in binary sequences representative of borehole data.

2. In a drill string acoustical data transmission system which provides an inherent resonant environment for acoustic signals, a method of receiving and retransmitting an intermittent acoustical signal representative of binary data in a coherent manner, comprising the steps of:

receiving the acoustical signal in the resonant environment of the drill string during a first time interval;

retransmitting said acoustical signal through the resonant environment of the drill string during a second time interval;

ceasing retransmission of said acoustical signal during a third time interval, wherein the second interval is shorter than the third time interval to ensure sufficient time to permit decay of the signal retransmitted during the second time interval; and ceasing reception of the acoustical signal during the second and third time intervals.

3. The method of claim 2 wherein the signal is retransmitted at a frequency different from the received frequency.

* * * * *